United States Patent [19]

Marzocco

[11] Patent Number: 4,976,059

[45] Date of Patent: Dec. 11, 1990

[54] DEVICE FOR EXTRACTING CARTRIDGE CASES FROM THE CARTRIDGE CHAMBERS OF SO-CALLED SWING-BARREL SHOTGUNS

[75] Inventor: Alessandro Marzocco, Milan, Italy

[73] Assignee: Luigi Franchi S.p.A., Brescia, Italy

[21] Appl. No.: 433,920

[22] Filed: Nov. 9, 1989

[30] Foreign Application Priority Data

Nov. 18, 1988 [IT] Italy ..... 22671 A/88

[51] Int. Cl.[5] ..... F41A 15/06

[52] U.S. Cl. ..... 42/46; 42/47

[58] Field of Search ..... 42/46, 47

[56] References Cited

U.S. PATENT DOCUMENTS 3,964,198 6/1976 Waddell .

*Primary Examiner*—Charles T. Jordan

*Assistant Examiner*—Richard W. Wendtland

[57] ABSTRACT

In a device for extracting cartridge cases from the cartridge chambers of so-called swing-barrel shotguns, an extractor is held in a retracted position relatively to the cartridge chamber by a check mechanism activated by a re-set device which comprises a body having a selected mass and being guided for movement on the gun along an interfering path with the check mechanism and driven along said path by the recoil force brought about by firing.

4 Claims, 3 Drawing Sheets

Figure 1:
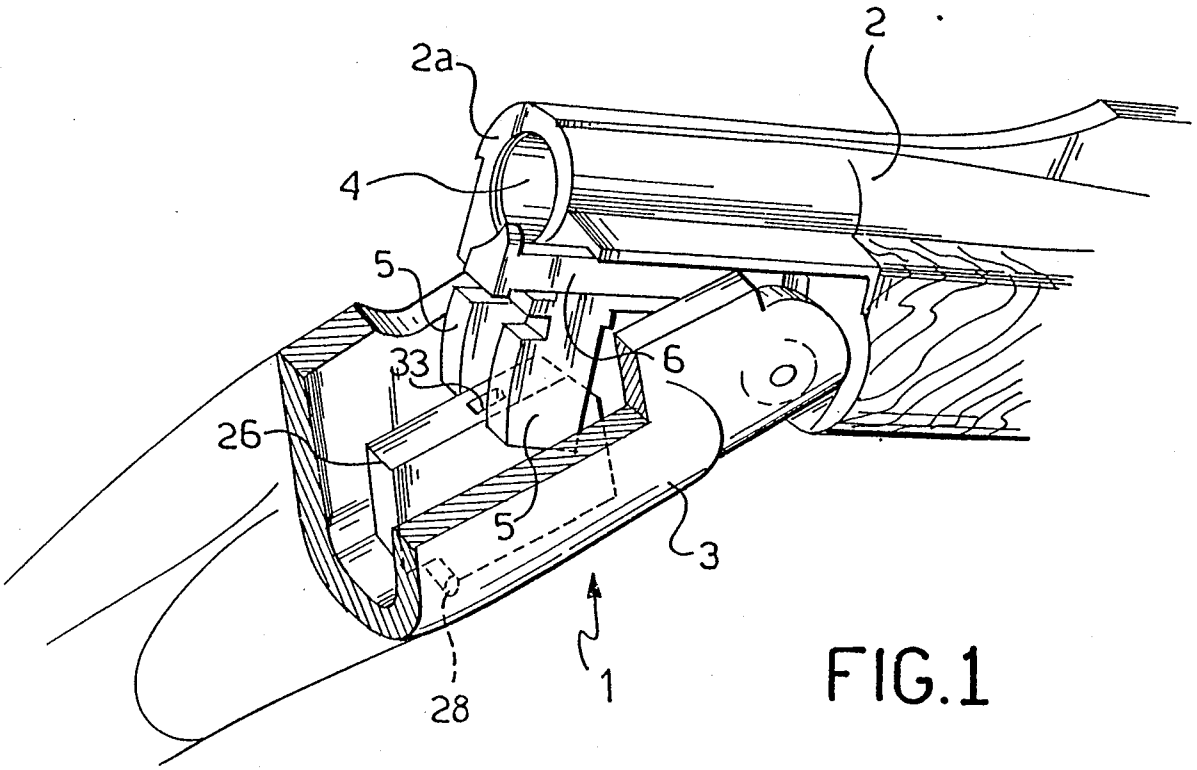

DEVICE FOR EXTRACTING CARTRIDGE CASES FROM THE CARTRIDGE CHAMBERS OF SO-CALLED SWING-BARREL SHOTGUNS

This invention relates to a device for extracting cartridge cases from the cartridge chambers of so-called swing-barrel shotguns, being of a type which comprises an extractor movable between a first or retracted position and a second or extracted position relative to a cartridge chamber, resilient members urging said extractor toward the extracted position, check members acting on the extractor in the retracted position thereof when activated by a re-set device, and a means of disengaging the extractor from said check members.

Examples of swing-barrel shotguns are double-barrelled shotguns, superimposed barrel shotguns, and certain single-barrelled shotguns. To remove the cartridge cases of fired shots, the gun is opened by swinging the barrel assembly relative to a swing mount to which it is pivoted; the cartridge case extracting operation is assisted by a device which, on opening the gun, automatically ejects the cases either part way or all the way out of their respective cartridge chambers.

The extractor devices employed on currently known shotguns are basically of two types: a first type embracing those devices which are designed for partial extraction of the cases from the cartridge chambers, the operation being performed gradually as the gun is being opened; and a second type embracing so-called ejector devices effective to suddenly eject the cartridge case all the way out.

With the devices of the first type, each extractor, urged by a spring away from the cartridge chamber, is held back in its "out" travel by guides formed on the mount, so that the case movement away from the cartridge chamber will be both a progressive and proportional one to the shotgun swing-open movement.

With devices of the second type, the action of the spring that urges the extractor toward the extracted position from the cartridge chamber is resisted, during the initial portion of the gun swing-open movement, by appropriate check members which will hold the extractor in the retracted position; on exceeding a predetermined swing angle, the extractor is suddenly released to eject the cartridge case out of the cartridge chamber.

The check members are re-set to the extractor-holding condition primarily by utilizing the energy released by the firing mechanism, in particular by the cock which, in its travel to strike the firing pin, exerts a mechanical re-set action on the check members.

This unavoidably weakens the striking action of the cock, thereby making a gun jam more likely to occur.

Another drawback exhibited by both of the above-noted extractor device types, is that the cartridge case extraction mode must be unequivocally choosen at the time of buying the gun, it being impossible to adapt ejectors on contingent request for slow extraction of the cartridge case, and conversely, slow extractors for full ejection of the case from the cartridge chamber.

The technical problem that underlies this invention is to provide a device for extracting cartridge cases from the cartridge chambers of so-called swing-barrel shotguns, which has such structural and performance characteristics as to overcome the drawbacks with which the cited prior art is beset.

This problem is solved, according to the invention, by a device as indicated being characterized in that the re-set device for the check members comprises a body having a selected mass which is guided for movement on the gun along an interfering path with said check members and is driven along said path by the recoil force brought about by firing.

Figure 2:
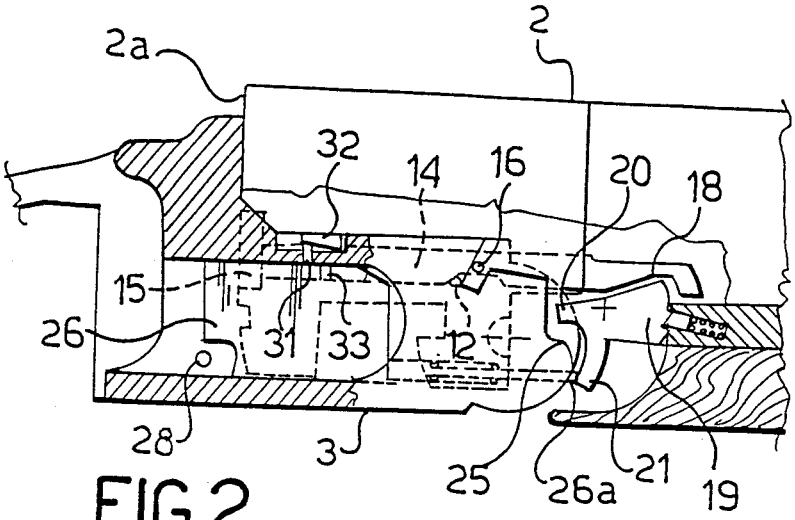
Figure 3:
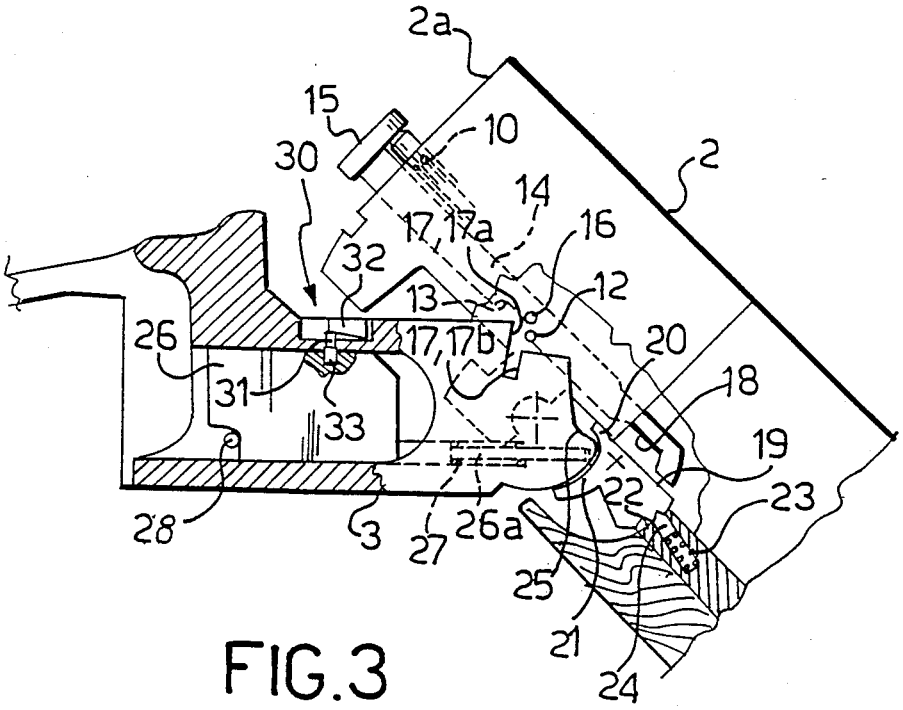
Figure 4:
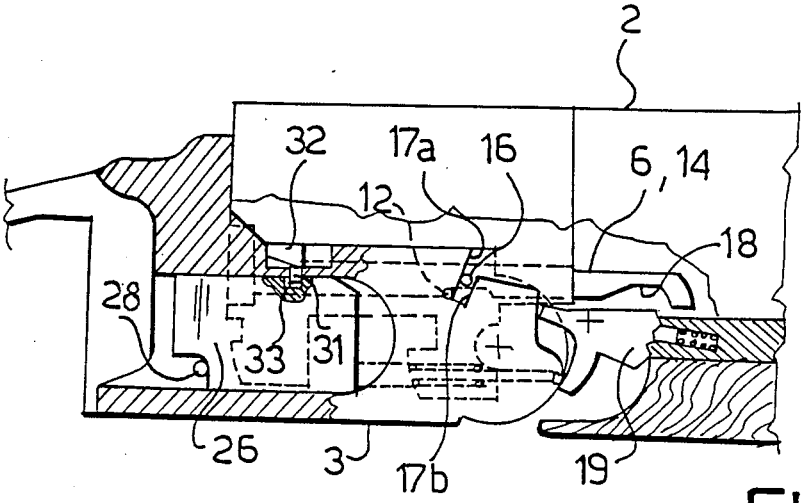
Figure 5:
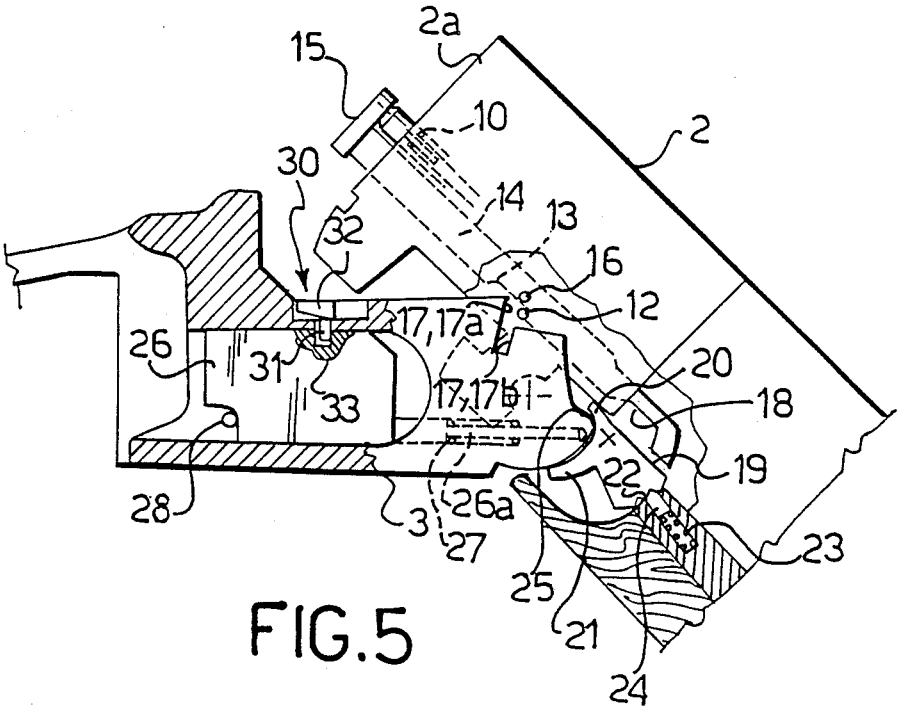

The features and advantages of the invention will become more clearly apparent from the following detailed description of a preferred, though not exclusive, embodiment thereof, to be taken by way of illustration and not of limitation in conjunction with the accompanying drawings, where:

FIG. 1 is a fragmentary perspective view of a shotgun incorporating the device of this invention;

FIGS. 2 and 3 are views showing schematically the gun of FIG. 1 in the closed and opened conditions thereof, respectively, wherein the extraction device is arranged to operate as an ejector; and FIGS. 4 and 5 are schematic views of the gun shown in FIG. 1 in the closed and opened conditions thereof, wherein the extractor device is arranged to provide a gradual cartridge case extraction part way out of the cartridge chambers.

Shown in FIG. 1 in the opened condition is a single-barrelled shotgun 1 wherein a barrel 2 is pivoted on a swing mount 3 whereby this gun is referred to as a swing-barrel shotgun.

Defined at the breech end 2*a* of the barrel 2 is a cartridge chamber 4 intended for receiving a cartridge, not shown.

Two dogs, both indicated at 5, depend from the bottom portion of the barrel 2 and are effective to hold the barrel in the closed position onto the swing mount 3 with the shotgun 1 in the cocked state (position of FIG. 2).

An extractor 6 is guided slidably on one side of the barrel 2 in a parallel direction to the latter; the extractor 6 is movable between an extracted position (FIG. 1) and a retracted position (FIG. 2) relative to the barrel 2, and is biased by a spring 10 constantly toward the extracted position.

The travel distance between said extracted and retracted positions is limited by a peg 12 attached to the underside of the barrel 2 at a cutout 13 formed in a stem 14 of the extractor 6.

Attached to one end of the stem 14, on the side of the breech end 2*a*, is a head 15 extending some distance around the cartridge chamber 4 so as to interfere with a rim portion of a cartridge case.

Secured across an intermediate section of said stem 14 is a pin 16 which is adapted to engage, in a manner known per se, two juxtaposed sides 17*a*, 17*b* of a guide 17 formed in the swing mount 3.

At the opposite end of the stem 14 from the head 15, there is formed a cutout 18 which cooperates with a check mechanism pivoted underneath the barrel 2 for a function to be explained hereinafter.

The check mechanism 19 has, on its side facing toward the breech end 2*a* of the barrel 2, first and second arms, respectively indicated at 20 and 21, and the opposed side, notches 22 into which a small plunger 24 is urged by a spring 23.

The first arm 20 cooperates with a cam profile 25 formed on the swing mount 3 at the pivotal connection for the barrel 2, and is operative to swing the mechanism 19 to disengage the cutout 18 on the shotgun 1 being opened (position of FIG. 1).

The second arm 21 is also arranged to cooperate with the cam profile 25 to limit the extent of the swing imparted by the first arm 21 to the mechanism 19, and is subjected to the action of a body 26 having a predetermined mass and being slidable on the swing mount 3 along a parallel direction to the barrel 2 against the biasing force from a spring 27. A rod 26*a* is interposed between the body 26 and the arm 21. The body 26 and rod 26*a* jointly constitute a re-set device for the check mechanism 19.

Provided on the swing mount 3 is a means of selectively locking the body 26 against a stopper 28 to prevent any movement thereof toward the arm 21. This means, generally indicated at 30, comprises a peg 31 fitting slidably in a socket formed in the swing mount 3 transversely to the direction of movement of the body 26 under the action of a wedge 32 to engage, when the movement of the body 26 is to be inhibited, in a blind hole 33 formed in the latter.

Illustrated in FIGS. 1 to 3 is the operation of the inventive device where arranged to operate in the ejector mode.

By swinging the barrel 2 relatively to the swing mount 3 into the closed condition of the shotgun 1, the extractor 6 will be urged to the retracted position by the pin 16 acting on the side 17*a* of the guide 17. Thus, a cartridge can be introduced fully into the cartridge chamber 2*a*.

With the gun in the closed condition, prior to firing, the check mechanism 19 will occupy the position shown in FIG. 4 and exert no holding action on the extractor 6.

Upon firing, due to the recoil acceleration effect, the mass of the body 26 will undergo an inertia force and be displaced in a direction toward the mechanism 19 by overcoming the resistance from the spring 27.

By the interaction of the rod 26*a* with the second arm 21, the mechanism 19 is caused to pivot on the barrel, overcoming the resistance offered by the plunger 24 in the notches 22, until it engages in the cutout 18 provided on the stem 14 of the extractor 6.

When the shotgun 1 is opened again to eject the case of the now fired cartridge, the extractor 6 is displaced through an initial short distance toward the extracted position by the pin 16 acting against the side 17*b* of the guide 17. This initial movement stage of the extractor 6, as allowed for by a backlash provided between the check mechanism 19 and the cutout 18, is effective to dislodge the cartridge case, now in an expended condition due to the firing, from the cartridge chamber 2*a* and to cause the extractor 6 to abut against the check mechanism 19 with the end portion of the cutout 18.

As the oscillatory movement of the barrel 2 relatively to the swing mount 3 continues, the first arm 20 of the mechanism 19 will come to interfere with the cam profile 25 on the swing mount 3, causing the mechanism 19 to pivot toward the position of FIG. 3, and hence release the extractor 6 which will be suddenly thrown by the spring 10 into the fully extracted position. The sudden acceleration of the extractor will cause the cartridge case to be ejected all the way out.

Where the shotgun 1 is to be operated for gradual extraction of the cartridge case part way out, the body 26 should be locked through the means 30. In fact, on the wedge 32 being moved in the direction toward the breech end, the peg 31 is introduced into the hole 33 in the body 26 to inhibit any movement of the latter.

In this mode, on opening the shotgun, the cartridge case will again become dislodged by the mechanical interaction of the pin 16 with the side 17*b* of the guide 17, but the remainder of the extraction travel, as provided by the elastic energy of the spring 10, will be slowed down by the pin 16 engaging with the side 17*a* of the guide 17.

As may be appreciated from the foregoing detailed description, a major advantage of this shotgun is that the re-setting of the extractor checking mechanism is solely accomplished at the expense of the inertia force induced on the gun on firing a shot by the recoil effect, that is without detracting from the energy of the firing mechanism, and in particular of the cock.

Another important advantage is that one can select at will the cartridge case ejector or gradual extractor modes of operation of this device.

In addition, the inventive device is simple construction-wise and reliable in operation.

I claim:

1. A mechanism for removing the cartridge case from the cartridge chamber of the barrel pivotably mounted on the swing mount of a swing-barrel shotgun, comprising:

an extractor means for removing the cartridge case from the cartridge chamber, said extractor means movable between a retracted position and an extracted position;

resilient members urging said extractor toward the extracted position;

a check means for retarding movement of said extractor means, said check means movable between an engaged position relative to said extractor means and a disengaged position relative to said extractor means, said check means retarding movement of said extractor means when in said engaged position;

a rest means for moving said check means into said engaged position, said reset means including a body having a predetermined mass and a rod, said body being guided for movement along an interfering path with said check means and being driven along said path by the recoil force, occurring upon firing of the cartridge case; and a disengaging means for moving said check means into said disengaged position.

2. A mechanism according to claim 1 further comprising a locking means for preventing movement of said reset means along the interfering path to move said check means into said engaged position.

3. A mechanism according to claim 2 wherein said reset means is guided along the interfering path, which lies substantially parallel to the barrel axis, against the bias force of an elastic means resisting the movement of said body as due to the recoil force.

4. A mechanism according to claim 3 wherein said reset means is mounted on the swing mount.

* * * * *